US009788630B2

(12) United States Patent
Vinokur et al.

(10) Patent No.: US 9,788,630 B2
(45) Date of Patent: Oct. 17, 2017

(54) MANICURE BOWL HAVING ERGONOMIC WRIST REST

(71) Applicant: FOOTSIEBATH, LLC, Beverly Hills, CA (US)

(72) Inventors: Genya Vinokur, Los Angeles, CA (US); Michael Vinokur, Los Angeles, CA (US)

(73) Assignee: Footsiebath LLC, Beverly Hills, CA (US)

( * ) Notice: Subject to any disclaimer, the term of this patent is extended or adjusted under 35 U.S.C. 154(b) by 123 days.

(21) Appl. No.: 14/835,577

(22) Filed: Aug. 25, 2015

(65) Prior Publication Data

US 2017/0055671 A1 Mar. 2, 2017

(51) Int. Cl.
*A45D 29/00* (2006.01)

(52) U.S. Cl.
CPC ..... *A45D 29/00* (2013.01)

(58) Field of Classification Search
CPC ..... A45D 29/00; A45D 29/18; A45D 29/22; A45D 31/00; A47G 19/02; A47G 19/22; B65D 1/34; B65D 21/0233; B65D 25/28; B65D 25/2802; Y10T 16/44
USPC ..... 132/73.5, 73; 220/755, 756, 769, 771, 220/914; 206/515, 518, 519; D28/61; 135/73.5, 73
See application file for complete search history.

(56) References Cited

U.S. PATENT DOCUMENTS

| | | | | | |
|---|---|---|---|---|---|
| 2,169,990 | A | | 8/1939 | Preve | |
| 2,171,804 | A | * | 9/1939 | Perez | A45D 29/22 132/73 |
| 2,245,929 | A | | 6/1941 | Mangold | |
| D155,435 | S | * | 10/1949 | Mangold | 132/73 |
| 2,540,899 | A | | 2/1951 | Mangold | |
| 2,561,001 | A | * | 7/1951 | Ward | A45D 29/00 132/73 |
| D165,782 | S | * | 1/1952 | Parker | 220/710.5 |
| 2,580,981 | A | * | 1/1952 | Webster | A45D 29/00 132/73 |
| 2,661,609 | A | * | 12/1953 | Revell | A47G 19/22 220/710.5 |
| 2,816,556 | A | | 12/1957 | Weber et al. | |
| 2,937,783 | A | * | 5/1960 | Press | A47G 19/23 206/515 |
| 3,961,636 | A | * | 6/1976 | Mele | A45D 29/22 132/73 |
| 7,165,555 | B2 | | 1/2007 | Lee | |
| 8,763,808 | B2 | * | 7/2014 | Juric | A01G 25/14 206/503 |

(Continued)

FOREIGN PATENT DOCUMENTS

| | | | |
|---|---|---|---|
| JP | 2006-311892 | * | 11/2006 |
| WO | WO2016043042 | * | 3/2016 |

*Primary Examiner* — Todd E Manahan
*Assistant Examiner* — Jennifer Gill
(74) *Attorney, Agent, or Firm* — Tsircou Law P.C.

(57) ABSTRACT

A manicure bowl is provided having an ergonomic wrist rest incorporated into the bowl area, and providing additional support to the manicure bowl. The wrist rest can additionally function as a handle for the manicure bowl. Additionally, the wrist rest, and the outside of the wall of the bowl under the rest and behind the neck of the wrist rest, are receded as to accommodate another manicure bowl fully nested inside it when manicure bowls are stacked on top of one another.

12 Claims, 3 Drawing Sheets

(56) References Cited

U.S. PATENT DOCUMENTS

2011/0139169 A1* 6/2011 Gerschman ..... A45D 44/00
132/200

* cited by examiner

MANICURE BOWL HAVING ERGONOMIC WRIST REST

FIELD OF THE INVENTION

The present invention relates generally to manicure bowls and, more particularly, to a manicure bowl further having an ergonomic wrist rest.

BACKGROUND OF THE INVENTION

While receiving a manicure at beauty salons, clients customarily have their hand soaked in a basin of warm liquid. Soaking softens the skin and nails and has many other therapeutic benefits that include stimulating circulation of the blood and otherwise alleviating fatigue. Consequently, soaking is a particularly enjoyable and important part of having a manicure.

In a salon setting, a manicure bowl can be used by dozens of clients in a single day. Therefore, hygienic practices regarding use of the bowls are an important consideration. It is common and often required, that the bowl is emptied and cleaned between uses. However, such repeated cleaning can reduce the life of the bowl and can be time consuming. Instead, to cut down on repeated cleanings while promoting hygiene, many salons use makeshift liners such as plastic sacks, particularly those commonly used for groceries. Although generally effective, such plastic sacks lack sufficient rigidity to remain in place. Thus, leaking can be problem and, even if properly secured, wet sacks can feel odd against the client's skin. In addition, use of plastic bags lack esthetic appeal.

In current approaches, it is typically required that the technician move the entire manicure bowl filled with liquid to discard the liquid in between uses. This can be time consuming and inefficient when each bowl must be individually moved, cleaned, then replaced for the after each use.

When soaking hands specifically, it is important to provide support to the wrist area so a client is not force to hold their hands at awkward angle for the duration of the soaking. During soaking, clients must submerge their finger and hands in the manicure bowl, causing their wrists to be extended at an upward angle over the sides of the bowl. Maintaining this position for the duration of soaking can cause fatigue or pain in the client's wrist. Current approaches exist but are limited in their application and efficacy. They may not apply to a variety of client's different wrist sizes and shapes, as well as being oversized or bulky affecting efficiently storage of the soaking basin.

It should, therefore, be appreciated that there exists a need for a manicure bowl having a disposable liner, and integrated wrist support, that provides a hygienic, therapeutic soak and is cost-effective to manufacture. The present invention fulfills this need and others.

SUMMARY OF THE INVENTION

Briefly, and in general terms, a manicure bowl is provided having a bowl area, a disposable liner, and an ergonomic wrist rest projecting from the rim of the bowl. The bowl area having a flat bottom base with curved walls projecting up from the base forming the bowl area. The manicure bowl also has an ergonomic wrist rest projecting from the rim of the bowl. Additionally the wrist rest can function as a handle for the manicure bowl.

More specifically, in an exemplary embodiment, the bowl area includes a flat bottom base, a curved peripheral wall projecting upwardly therefrom, which combine to define the bowl area for receiving the disposable liner. The curved wall is recessed on the outside of the bowl, under the wrist rest area, directly behind the neck of the wrist rest as it disposed in the bowl area. This functions to accommodate the neck area of the wrist rest of another manicure bowl being stacked inside the bowl. The liner is configured to nest with the bowl area. The bowl area provides structural support to the manicure bowl, allowing the liner to be particularly thin, e.g., 0.03-0.50 mm, without sacrificing the stability of the manicure bowl.

In a detailed aspect of an exemplary embodiment, the wrist rest includes a neck that is disposed in the bowl. The wrist rest additionally includes a first hump proximate to and above the rim of the bowl. A second hump is distal therefrom and higher than the first hump, and a recess is between the first and second humps. Distal of the second hump the wrist rest curves down and extends to be in line with the flat bottom base, acting as a support for the manicure bowl when resting on a flat surface. This section of the wrist rest contains a cutout in the middle, only retaining only a small amount of material to maintain structural support. Finally, the wrist rest itself, leading into the lip of the bowl area, is recessed. In exemplary embodiment, the spacing between the first and second hump is used to support the wrist comfortably when the fingers are soaked in the bowl.

In another detailed aspect of an exemplary embodiment, the wrist rest functions as a handle for the manicure bowl, capable of supporting the full weight of the bowl and disposable liner when filled with fluid.

Additionally in another detail aspect of exemplary embodiment, the manicure bowl can be stacked on top of another unit, fully fitting inside each other. The bowl area is recessed on the outside of the bowl, under the wrist rest area, directly behind the neck of the wrist rest, as it is disposed in the bowl area. The wrist rest is recessed as to accommodate the width and depth of another wrist rest nesting inside of it. When one manicure bowl is laid on top of another, the manicure bowl is designed in such a way as to nests fully inside the other.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
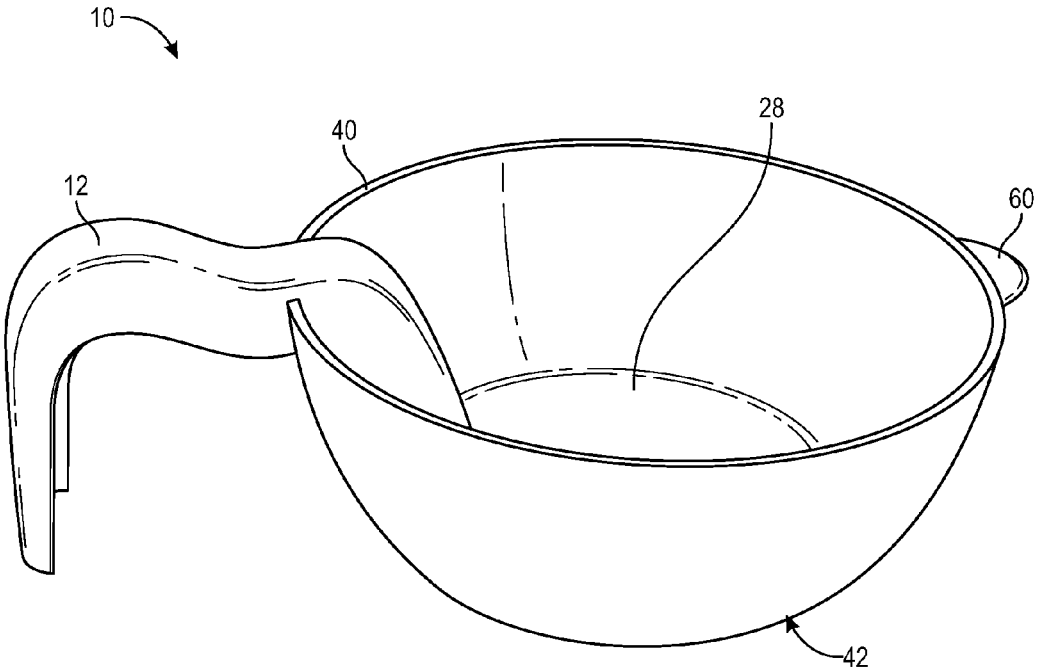
FIG. 1 is a slightly overhead and profile perspective view of a manicure bowl having a bowl area and a wrist rest in accordance with the invention.

Referring now to the drawings, and particularly FIG. 1, there is shown the manicure bowl having bowl area 10 and wrist rest 12. A lip 60 is disposed on the rim of the bowl, directly across from the wrist rest 12. The lip 60 projects outward away from the center of the bowl, and allows the bowl to be picked up from both sides when moving the bowl. This is particularly helpful when the manicure bowl is filled with liquid. The profile of the bowl 10 is slanted outwards allowing for the stacking of multiple bowls on top of one another. The circumference of the bowl rim 40 is measured between nineteen inches (R=3 in) and thirty-eight inches (R=6 in). The height of the bowl 10 from base 42 to rim 40 is measured between three inches and eight inches. The circumference of the base 42 of the bowl is measured between twelve inches (R=2 in) and thirty-two inches (R=5 in). The angle of the outward slope of the bowl 10 is measured relative to the ratio between the circumference of the bowl rim 40 and that of the base 42 of the bowl. The total volume of the bowl 10 is sufficient to hold enough liquid for soaking fingers or hands. The bowl 10 is sufficiently sized as to comfortable accommodate a wide variety of the shapes and sizes of different persons' hands. The material the bowl is constructed of plastic. The wrist rest 12 is the same material as the bowl 10 and are one continuous piece.

Figure 2:
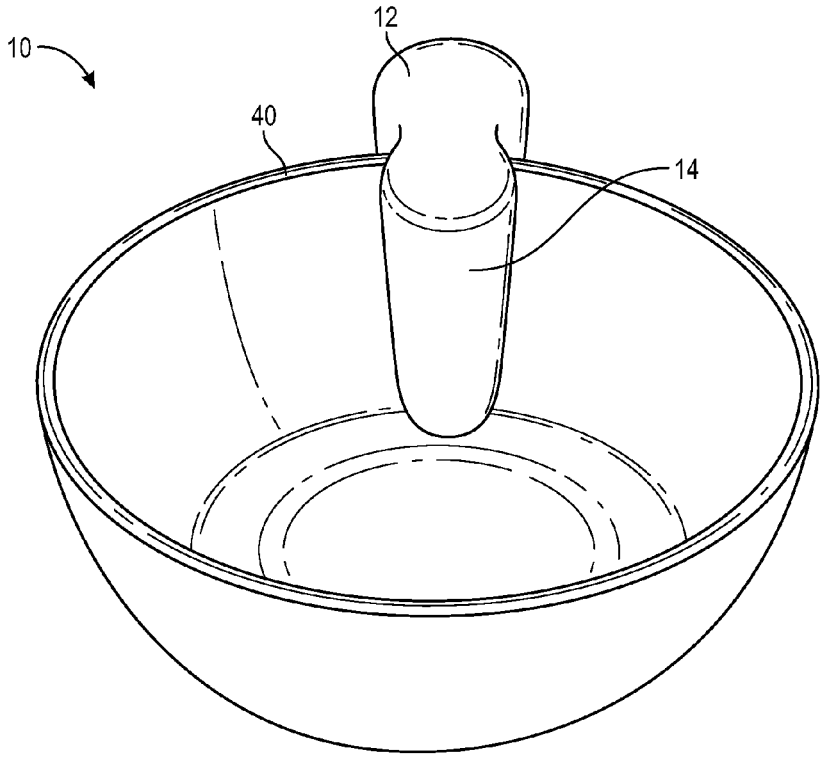
FIG. 2 is a front oriented top perspective view of the manicure bowl of FIG. 1, depicting the bowl area and neck of the wrist rest disposed in the bowl.

With reference now to FIG. 2, the bowl area 10 is shown with the neck 14 being disposed into the bowl area. The wrist rest 12 extends proximate and over the top of the rim 40 of bowl area 10.

Figure 3:
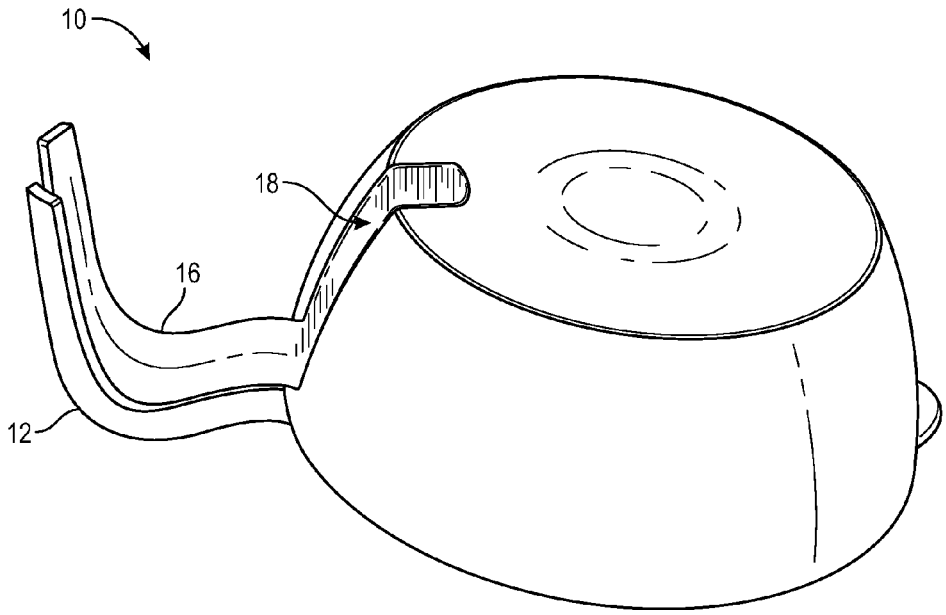
FIG. 3 is an bottom facing underside view of the manicure bowl of FIG. 1, depicting the recessed area on the outside of the bowl area, under the wrist rest and directly behind where the neck is disposed inside the bowl area, and depicting the recessed nature of the wrist rest.

With reference now to FIG. 3, the bowl area 10 is recessed in portion 18. Recessed area 18 is located under the wrist rest 12 directly behind the neck 14. The recessed area is measured between 0.25 inches and 1.0 inches for depth, and between 0.25 inches and 2 inches in width. The recessed area 18 allows for the neck 14 of another manicure bowl to be fully nested inside the recessed area 18. The wrist rest 12 is convex as to contain a recessed area 16, allowing for the width and depth of another wrist rest 12 to be nested inside when manicure bowls are stacked. The recessed nature 16 of the wrist rest 12 is measured between 0.25 inches and 1.0 inches for depth, and between 0.25 inches and 2 inches in width.

Figure 5:
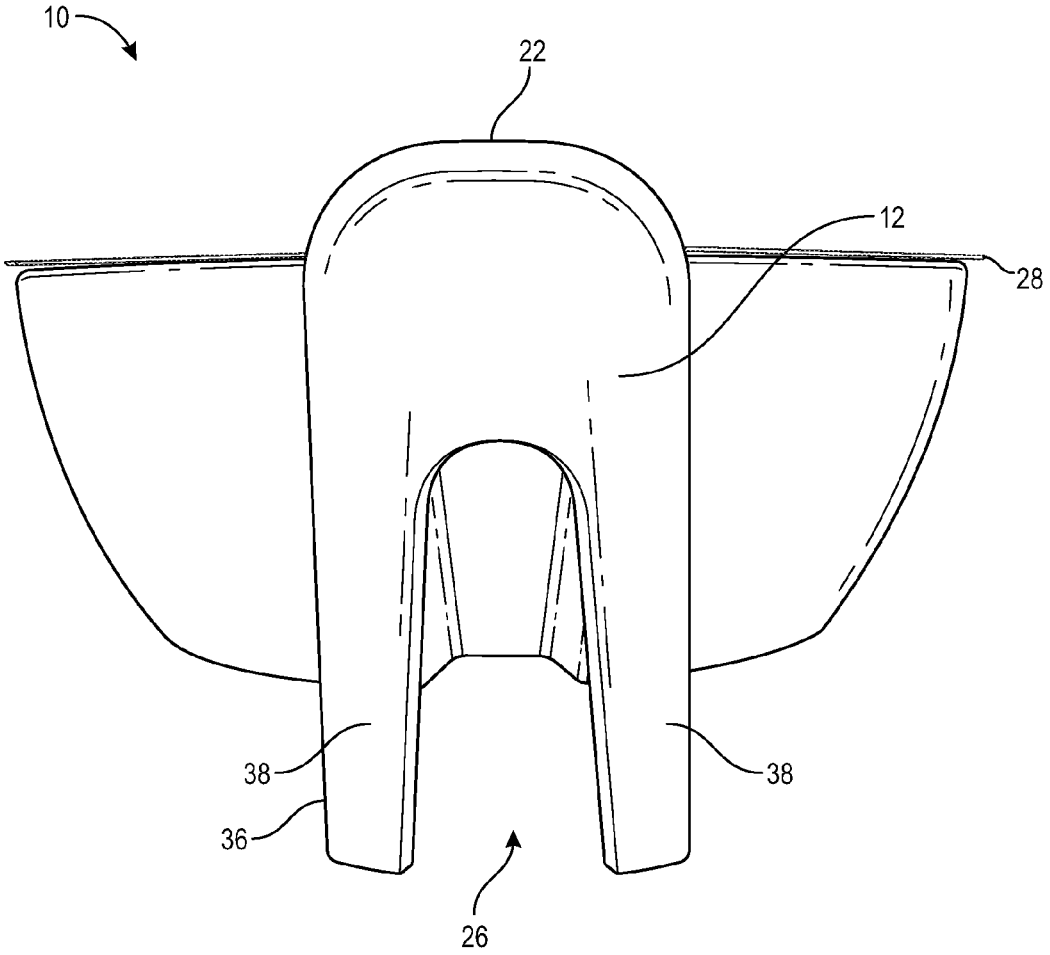
FIG. 5 is a rear perspective view of manicure bowl of FIG. 1, depicting the cutout area in the middle of the wrist rest, after it curves downwards distal of the first and second hump depicted in FIG. 4.

Additionally on FIGS. 1 and 5, there is depicted the disposable liner 28 which is constructed from plastic. Since the liner 28 is intended to be disposed after use, material cost for the liner is an important consideration. The liner is formed of liquid impermeable material such as plastic, e.g., polycarbonate or PET plastic. In the exemplary embodiment, the base unit is configured to provide structural support to the soaking basin, allowing the liner to be particularly thin, e.g., 0.03-0.50 mm, without sacrificing stability. In the exemplary embodiment the liner is about 0.30 mm.

The disposable liner 28 is pre-formed to closely nest inside bowl 10, making for a perfect fit with no space gap between liner 28 and bowl 10. Liner 28 has a lip around its edge, resting on top of the rim 40 of bowl 10, and extending sufficiently beyond the rim of bowl 10, allowing for the liner 28 to be easily removed. The pre-formed shape of the liner 28 conforms to the measurements of bowl 10, taking into account the dimensions of the bowl 10.

Figure 4:
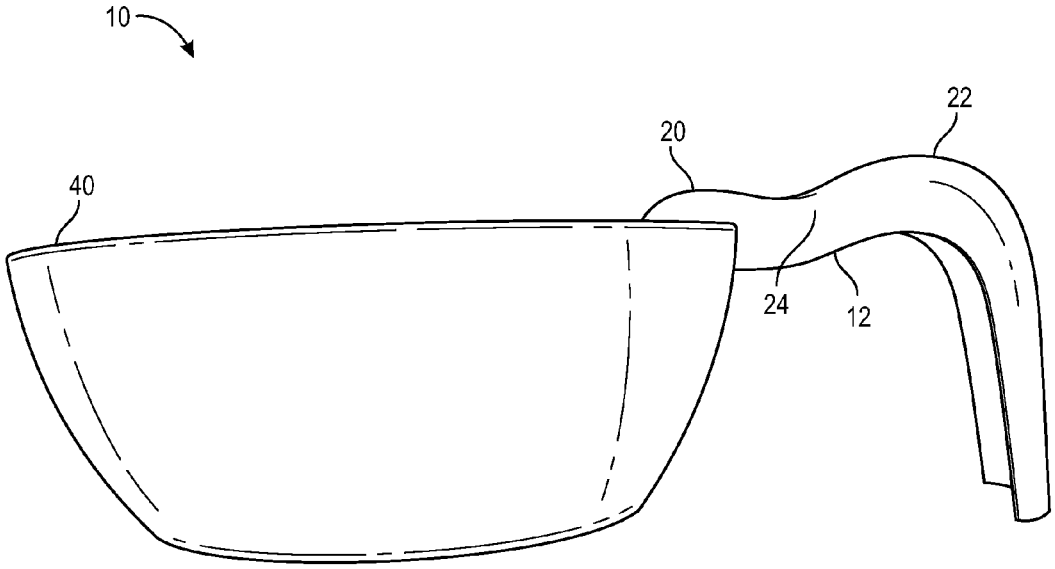
FIG. 4 is a side profile view of the manicure bowl of FIG. 1, depicting the bowl area, and first and second humps of the wrist rest.

With reference now to FIG. 4, the wrist rest 12 contains a first hump 20 and second hump 22 with a recessed area 24 between both humps. The first hump 20 has a height that is greater than the height of the bowl rim 40. The second hump 22 has a greater height than the first hump 20 as to allow the most comfortable position to rest a wrist while soaking fingers and hands in bowl 10. The height ratio between second hump 22 and first hump 20 is between 1.1-1.4. This recessed area 24 between hump 20 and 22 is to function as the area to rest the wrist when soaking the fingers and hands in the bowl area 10. The ratio of the height of the recessed area's 24 depth to the height of the bowl rim 40 is a ratio of 0.8 to 1.0 and is disposed below the first hump 20. The first hump 20 is located directly over the rim 40 of bowl 10. The distance between the second hump 22 and the rim 40 of the bowl 10 is measured between three to six inches.

The wrist rest 12 may additionally function as a handle for the bowl 10, fully supporting the weight of the bowl 10 even when filled with liquid.

With reference now to FIG. 5, there is shown the bowl area 10 with wrist rest 12 attached to bowl area 10. The support base 36 located behind second hump 22 on wrist rest 12 is cutout 26 in the middle, only retaining a small amount of material to maintain structural integrity. The height of the cutout area 26 is measured between 25% and 80% of the distance between the ground and the second hump. The width of the cutout area 26 is measured between 25% and 80% of the width of the support base 36. The two pieces 38 of material retained for structural integrity located on either side of the cutout area 26 each have a width ranging from 0.25 inches to one inch.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A manicure bowl for supporting the wrist comfortably while the fingers are soaked in the bowl, the manicure bowl comprising:

a bowl having a flat base and a sidewall extending curvilinearly upward therefrom terminating in a rim of the bowl, the bowl defining a bowl area used as a soaking basin for a user's fingers, a lip disposed on the rim of the bowl, extending outward from the rim to facilitate lifting the bowl from both sides;

a wrist rest projecting from the rim of the bowl, opposite the lip, having a first hump proximate to and above the rim of the bowl area, a second hump distal therefrom and higher than the first hump, and a recess between the first hump and the second hump; and the wrist rest further having a plurality of legs projecting from the second hump to a surface for support, and a neck projecting from the first hump into the bowl area, the neck formed from a pushed out portion of the bowl sidewall and the pushed out portion has a corresponding recessed area on an exterior of the bowl, allowing for an identical manicure bowl to be fully nested inside the recessed area for stacking purposes.

2. The manicure bowl as defined by claim 1, wherein the ratio of the height of the second hump to the height of the first hump is between 1.1 and 1.4.

3. The manicure bowl as defined by claim 1, wherein the ratio of the height of the low point of the recess between the first and second humps to the height of the rim of the bowl is between 0.8 and 1.0.

4. The manicure bowl as defined by claim 1, wherein the bowl sidewall circumscribes the base and the bowl sidewall slants outwards relative to the base, allowing for the stacking of multiple bowls.

5. The manicure bowl as defined by claim 1, wherein the first hump is disposed over the inside of the rim of the bowl.

6. The manicure bowl as defined by claim 1, further comprising a pre-formed disposable liner sized to nest in the bowl.

7. A manicure bowl for supporting the wrist comfortably while the fingers are soaked in the bowl, the manicure bowl comprising:

a bowl having a flat base and a sidewall extending upward therefrom terminating in a rim of the bowl, the bowl defining a bowl area used as a soaking basin for a user's fingers; and a wrist rest projecting from the rim of the bowl, having a first hump proximate to and above the rim of the bowl area, a second hump distal therefrom and higher than the first hump, and a recess between the first hump and the second hump;

the wrist rest further having a plurality of legs projecting from the second hump to a surface for support, and a neck projecting from the first hump into the bowl area, the neck formed from a pushed out portion of the bowl sidewall and the pushed out portion has a corresponding recessed area on an exterior of the bowl, allowing for an identical manicure bowl to be fully nested inside the recessed area for stacking purposes.

8. The manicure bowl as defined by claim 7, wherein the ratio of the height of the second hump to the height of the first hump is between 1.1 and 1.4.

9. The manicure bowl as defined by claim 7, wherein the ratio of the height of the low point of the recess between the first and second humps to the height of the rim of the bowl is between 0.8 and 1.0.

10. The manicure bowl as defined by claim 7, wherein the bowl sidewall circumscribes the base and the bowl sidewall slants outwards relative to the base, allowing for the stacking of multiple bowls.

11. The manicure bowl as defined by claim 7, further comprising a pre-formed disposable liner sized to nest in the bowl.

12. The manicure bowl as defined by claim 7, wherein the first hump is disposed over the inside of the rim of the bowl.

* * * * *